United States Patent [19]

Weiss

[11] Patent Number: 5,053,749

[45] Date of Patent: Oct. 1, 1991

[54] RETAINER FOR DOCUMENTS WITH ALARM

[76] Inventor: Andrew E. Weiss, 252 Oriole Pkwy., Apt. B-1, Toronto, Ontario, Canada, M5P 2H1

[21] Appl. No.: 417,194

[22] Filed: Oct. 4, 1989

Related U.S. Application Data

[63] Continuation-in-part of Ser. No. 280,333, Dec. 6, 1988, abandoned.

[51] Int. Cl.[5] ..... G08B 13/14

[52] U.S. Cl. ..... 340/568; 200/61.19; 340/309.15; 340/529; 340/571

[58] Field of Search ..... 340/568, 571, 309.15, 340/529, 530; 200/61.19

[56] References Cited

U.S. PATENT DOCUMENTS

| | | | |
|---|---|---|---|
| 1,546,509 | 7/1925 | Poole | 340/286 |
| 1,685,329 | 9/1928 | Lynch | 340/527 |
| 3,656,144 | 4/1972 | Forte | 340/283 |
| 3,855,588 | 12/1974 | Buckland, Jr. et al. | 340/309.4 |
| 3,913,087 | 10/1975 | McBrian | 340/568 |
| 3,959,789 | 5/1976 | McGahee | 340/529 |
| 4,190,828 | 2/1980 | Wolf | 340/571 |
| 4,480,250 | 10/1984 | McNeely | 340/568 |
| 4,584,571 | 4/1986 | Smit et al. | 340/572 |
| 4,652,865 | 3/1987 | Maharshak | 340/568 |
| 4,674,628 | 6/1987 | Prinsloo et al. | 206/38.1 |
| 4,692,745 | 9/1987 | Simanowitz | 340/568 |
| 4,719,453 | 1/1988 | Beck et al. | 340/568 |
| 4,721,948 | 1/1988 | Lin | 340/568 |

FOREIGN PATENT DOCUMENTS

| | | | |
|---|---|---|---|
| 46568/85 | 2/1986 | Australia | 340/568 |
| 1415669 | 8/1964 | France . | |

OTHER PUBLICATIONS

Sample Wallet enclosed, "Securacard TM", purchased Sep. 30/88, believed to be on Market one year prior.

*Primary Examiner*—Glen R. Swann, III
*Attorney, Agent, or Firm*—Spencer & Frank

[57] ABSTRACT

A document retainer (10) having receptacles (14) is provided. The retainer is equipped with clip switch contact sensors (46,50) in the retainer receptacles. Documents (12) held in the receptacles maintain the clip switch contact faces in a spaced relationship by being interposed therebetween. When a document is withdrawn, the contact faces spring into engagement, closing the contacts and thereby energizing an alarm circuit that has audible and inaudible alarms (20,18) to facilitate indication of the document withdrawal. A resetable timing device is provided to suppress the audible alarm for a period considered sufficient for a card transaction. Preferably, the retainer is in the form of a compact module that can be inserted into a receptacle in a wallet or can be attached to another object by use of a provided releasable attachment device. The attachment device is equipped with a detector to sense if the retainer has become detached from the object to which it was originally attached and energizes the alarm circuit in a manner to circumvent any alarm suppression timers thereby energizing the alarms (20,18) immediately.

23 Claims, 11 Drawing Sheets

RETAINER FOR DOCUMENTS WITH ALARM

CROSS-REFERENCE TO A RELATED APPLICATION

This is a continuation-in-part of application Ser. No. 07/280,333 filed 12/06/88, now abandoned.

BACKGROUND OF THE INVENTION

The present invention relates to a system for retaining documents such that withdrawal and replacement of the documents from the retainer is sensed through the use of an electrical circuit and contacts incorporated into the retainer. In a more specific example, the present invention relates to the protection from loss of credit cards using a so-equipped wallet or purse.

At present the most common retainers for documents are file cabinets, brief cases, folders, purses and wallets. These retainers are intended to be used for organized storage and physical protection of documents and provide varying degrees of capacity, portability and security. With these retainers it is however, quite common for the user to forget to place the documents back into the retainer after use. As a result and most commonly with respect to credit, bank transaction and personal identification cards, the documents are left behind at point of use where they are particularly prone to loss, theft and misuse.

There have been several previous attempts at solving this problem. In particular, U.S. Pat. No. 3,959,789 discloses a credit card carrying case which incorporates contacts attached to the inside surfaces of separators adapted to hold credit cards and to detect the absence of a card. However, problems exist in this design in that the case is very bulky and uses a single external spring clip to bias the multitude of pairs of separator contacts together. The use of the single spring clip results in the contact pressure being spread over too wide an area thereby reducing the sensitivity of the device making the sensitivity too low for reliable detection.

U.S. Pat. No. 4,480,250 discloses a credit card carrier in which a series of clip switches bridge from the hinge or spine of a pair of folding flaps to common conductor strips, one strip being located on each side flap. An alarm is triggered if the edge of any card is not held between the assigned clip switch contacts when the flaps are folded to overlie one another, due to the closing of a magnetic proximity switch provided on the outboard edges of each flap. However problems exist in this design in that the edge to edge card holding layout is inconvenient in terms of space and area required per card. Furthermore, no facility is provided to guide the cards into position between the clip switch contacts nor to prevent them from falling out of position. In addition, the magnetic proximity switch is fragile, imprecise and difficult to align if the holder is flexible. Also, the magnetic switch might endanger the magnetic code strip common to most modern credit and bank cards.

U.S. Pat. No. 4,652,865 discloses a credit card holder composed of partly transparent pockets with conductive strips and/or disk-shaped magnetic contacts attached to the inside surfaces of the pockets in opposed alignment. The strips or contacts detect the withdrawal of credit cards and electrically activate an alarm system composed of a battery, buzzer and timer. In one embodiment, leaf springs are provided inside double layered pocket walls to urge the walls and attached contacts together. In another disclosed embodiment, the pockets are configured in book leaf form or edge to edge fold-up accordion fashion. However, problems exist in this device in that the use of the magnetic contacts may damage magnetic card coding provided on credit or bank cards. Furthermore, the leaf springs positioned between pocket lining layers may cause bulging of the pockets and without solid anchoring or support, may not provide sufficient force for reliable sensor contact pressure and function.

U.S. Pat. No. 4,692,745 discloses a holder for credit cards with an alarm circuit triggered by the withdrawal of a card from a receptacle and the subsequent closure of the holder. A light sensitive switch is used to prevent current flow to the alarm circuit when the holder is in the open position. Each set of card contacts is attached to a separate bracket thereby making the holder somewhat bulky. Many scenarios are envisioned wherein, if the holder is not fully closed and the light sensor is exposed when a card is missing, the alarm fails to sound, resulting in a lapse of the intended function of the device and loss of the card.

U.S. Pat. No. 4,719,453 discloses a wallet with an alarm actuable in a manner similar to that disclosed in U.S. Pat. No. 4,692,745. The card sensing means includes a plurality of clip switches arranged to be interconnected in parallel on a card plate.

U.S. Pat. No. 4,721,948 discloses a wallet with credit card holder that utilizes a flat flexible magnetic strip upon which two flat parallel conductors are insulatedly attached. Co-attractive conductive ferrous chips are opposingly attached to the inside of the far pocket walls such that the near pocket walls, which overlie the conductors, have openings to allow the chips clearance to attract magnetically into contact with the conductors upon withdrawal of a credit card. The chip bridges the conductors and closes the alarm circuit. The sensor function is completely dependant upon the magnetic attraction of the ferrous chips to the magnetic strips. Again problems exist in that damage may occur to the magnetic code provided on cards due to the magnetism. Moreover, the ferrous chip materials are subject to oxidation and subsequent poor conductivity.

Australian Patent No. AU-B-46568/85 discloses a security holder for a credit card with an alarm that senses the absence of cards from clip-switch-equipped receptacles. Each receptacle has a separate and structurally independent pair of clip switch contacts. The electric circuits disclosed in this reference include, in addition to receptacle sensors, a series connected timer with a hand holding pressure sensor operable to suppress the circuit function as well as a holder closure sensor. However, problems exist in this device in that if the contacts are arranged as disclosed with all the pairs overlapping each other, the resulting holder is quite bulky and complex to assemble. Also, the user must carefully fit the cards between the exposed clip switch leaf ends as there has been no consideration for passive guidance of the card between the clip switch contacts.

It is therefore an object of the present invention to provide a novel document retainer.

SUMMARY OF THE INVENTION

According to one aspect of the present invention there is provided a document retainer comprising:

a plurality of receptacles, each of said receptacles for receiving and holding a document therein;

sensing means associated with each of said receptacles for detecting the presence or absence of a document in said receptacle;

an electronic circuit responsive to said sensing means and being energized by a power supply upon detection of a document absent from said receptacle by said sensing means, said electronic circuit including:

an inaudible alarm operable to provide an inaudible signal upon energization of said electronic circuit;

an audible alarm operable to provide an audible signal;

time delay means in communication with said audible alarm and being operable to connect said audible alarm to said power supply after a pre-determined amount of time has elapsed after energization of said electronic circuit; and switch means in communication with said time delay means, said switch means being manually actuable to reset said time delay means to inhibit said audible alarm from sounding.

Preferably, the time delay means includes a counter which initiates a count upon energization of the circuit and that the audible alarm sounds once the count reaches a predetermined value. It is also preferred that the switch means returns the count to zero and that the count resumes once the switch means has been actuated and subsequently released.

In another aspect of the present invention there is provided a document retainer comprising;

a receptacle to receive a document;

sensing means having first and second electrical contacts disposed in said receptacle, said contacts having a pair of juxtaposed faces spring biased towards one another to be engageable with one another and to establish electrical contact therebetween, said faces being maintained in a spaced relationship by insertion of a document in said receptacle, each of said contacts being secured in an electrically insulated manner at one end thereof to a substrate;

said substrate maintaining said faces in alignment and preserving said spring bias;

said receptacle having front and back walls, constituting guide means for the insertion of a document in said receptacle and between said faces, each wall being provided with at least one aperture therein, each of said apertures allowing one of said faces to pass therethrough into the interior of said receptacle;

said substrate extending laterally beyond said contacts to provide laterally spaced marginal edges for attachment of said substrate to adjacent edges of said receptacle to maintain alignment of said substrate to said receptacle and said faces within said receptacle; and means provided to connect operatively said contacts to an alarm circuit to trigger said circuit upon the withdrawal of a document from said receptacle.

Preferably, the document retainer includes a plurality of receptacles each operable to receive a document. It is also preferred that the first contacts are formed on one electrically conductive plate and that the second contacts are formed on a second electrically conducive plate with both plates being attached to the substrate in a manner to maintain alignment of the contacts on the plates.

In still another aspect of the present invention there is provided a wallet case or cover provided with a receptacle comprising:

an opening to receive a modular document retainer and withdrawal sensor mechanism having an alarm, said receptacle being provided with a front wall and a back wall, said walls having apertures formed therein to allow the use of said mechanism while it is contained within said receptacle and permitting insertion and withdrawal of said documents from said mechanism in addition to facilitating use of manually controlled switches provided on said mechanism and functional sensing of said audible and inaudible alarms; and closure means to ensure containment of said mechanism within said receptacle and inhibiting lateral misalignment between said apertures and said mechanism.

In still yet another aspect of the present invention there is provided a document retainer comprising:

a plurality of receptacles, each of said receptacles for receiving and maintaining a document therein;

sensing means associated with each of said receptacles for detecting the presence or absence of a document therein;

an electronic circuit responsive to said sensing means and being energized by a power supply upon detection of the withdrawal of a document from any of said receptacles; and releasable attachment means provided on said retainer to allow attachment of said retainer to another object.

Preferably, the attachment means is in the form of a spring clip or hook and loop fabric. It is also preferred that the document retainer further includes detection means associated with the attachment means which is operable to sense removal of the document retainer from the object and an alarm which is energized by the power supply in response to the detection means. Preferably, the detection means is in the form of a pair of electrical contacts.

The present document retainer provides advantages in that alarms are initiated upon removal of documents from the retainer for a prolonged time or dislodgment of the retainer from an object to which the retainer is secured. This reduces the probability of loss of document or the document retainer. Moreover, the design of the document retainer facilitates placement and removal of documents therein to ensure that the documents are seated correctly for detection by the document sensing components in the document retainer.

BRIEF DESCRIPTION OF THE DRAWINGS

Preferred embodiments of the present invention will now be described by way of example only, with reference to the attached appended drawings in which:

FIG. I is a perspective view of a wallet;

Figure 1:
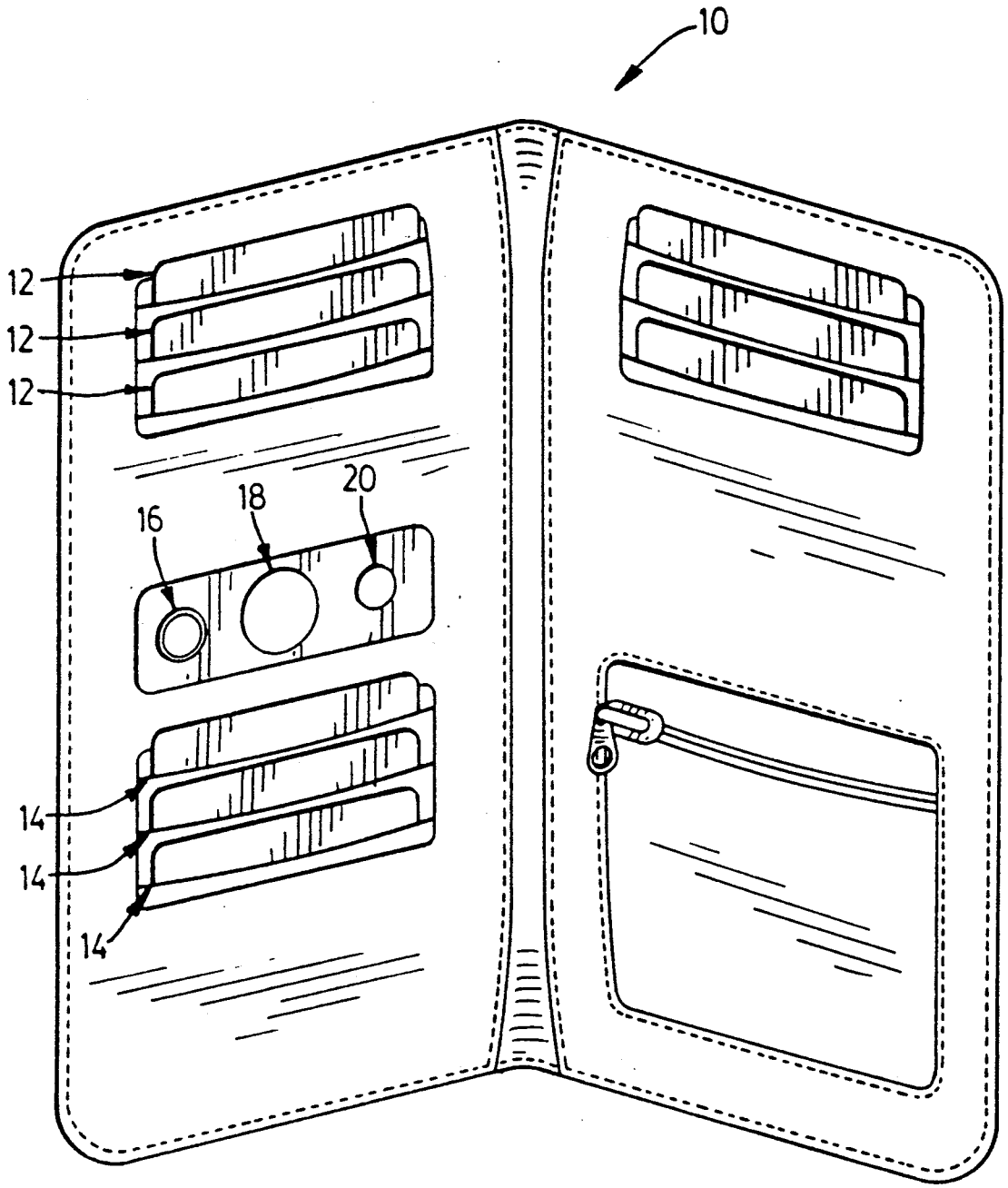
Figure 2:
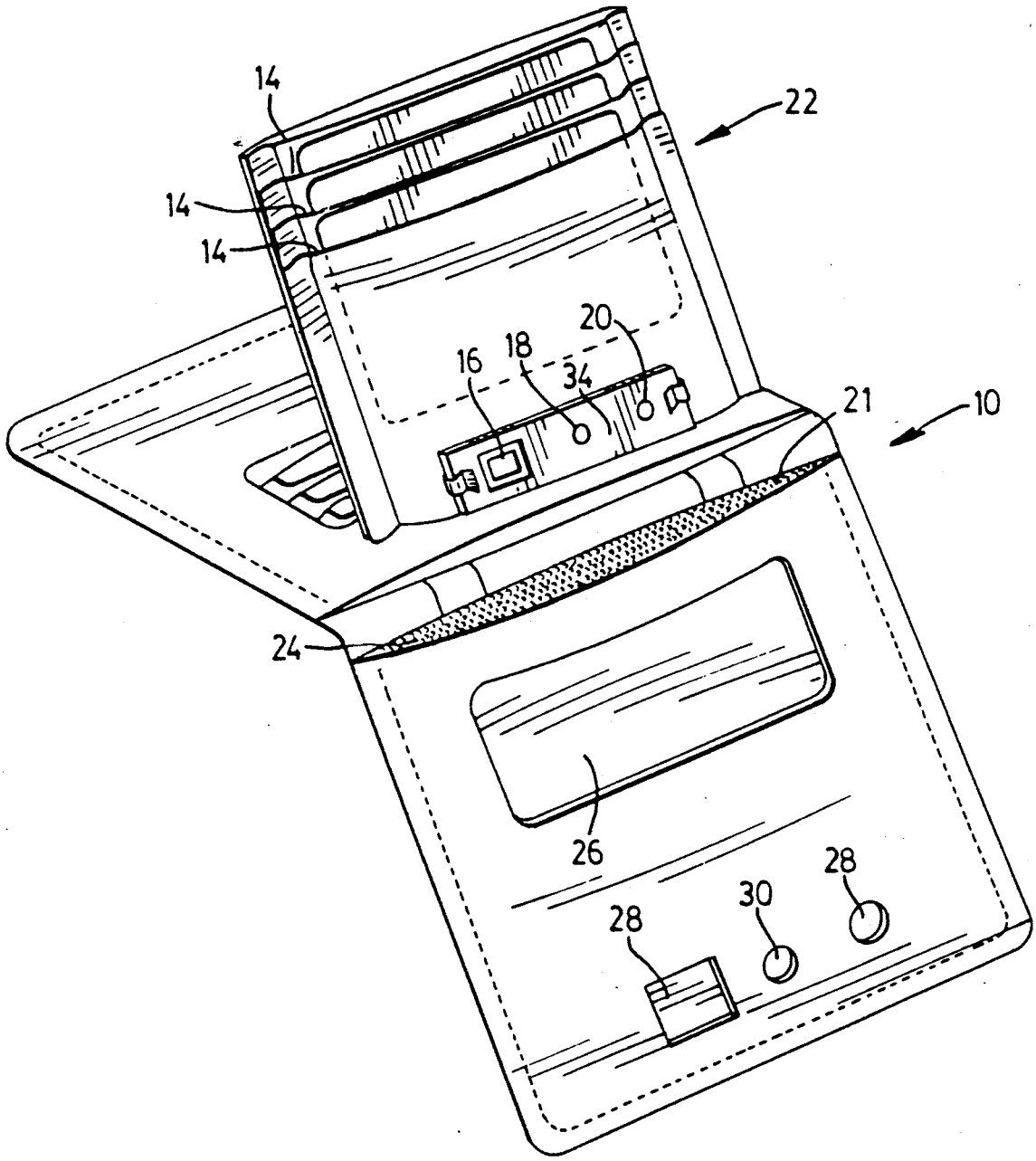
Figure 3:
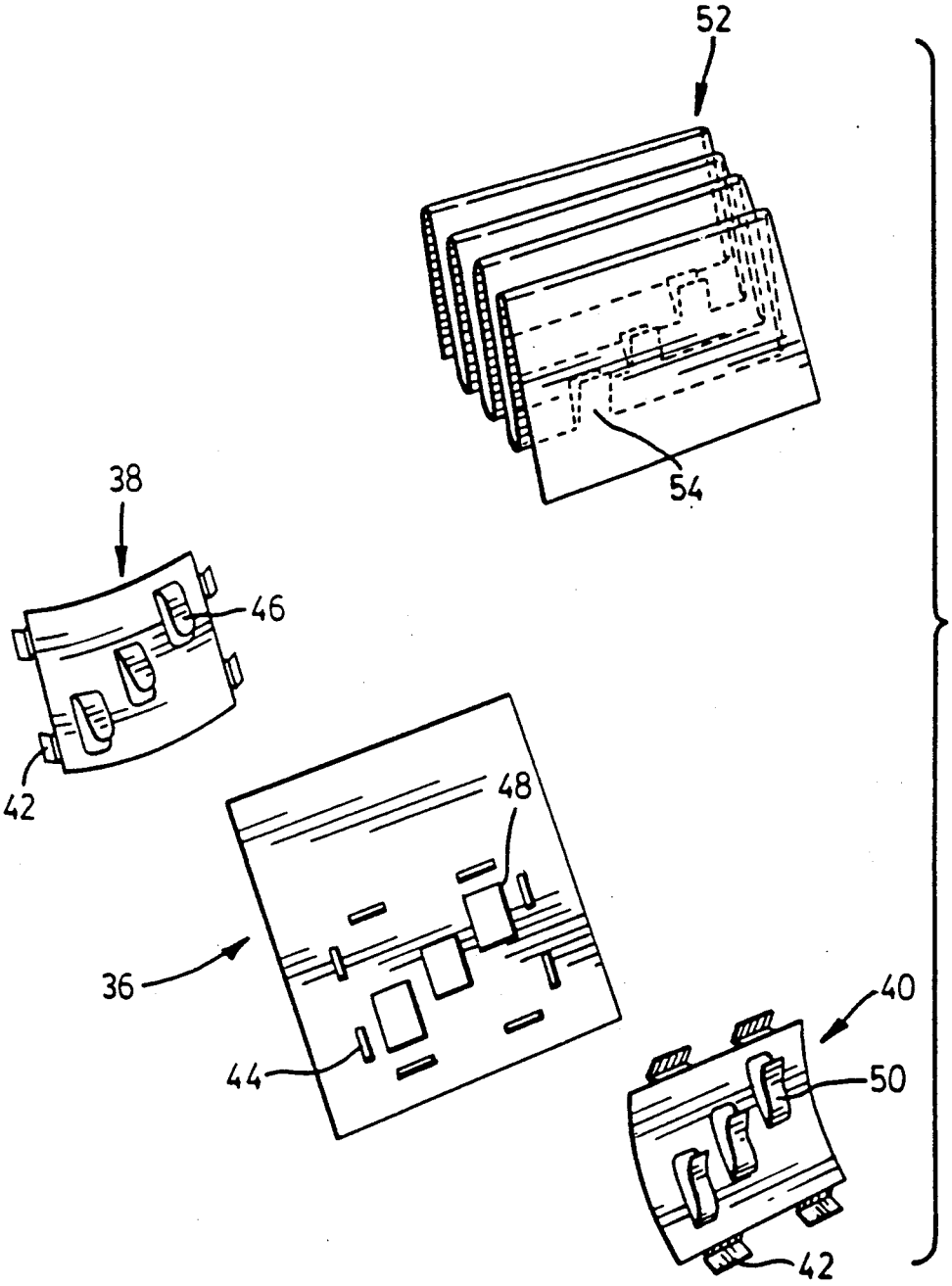
Figure 4:
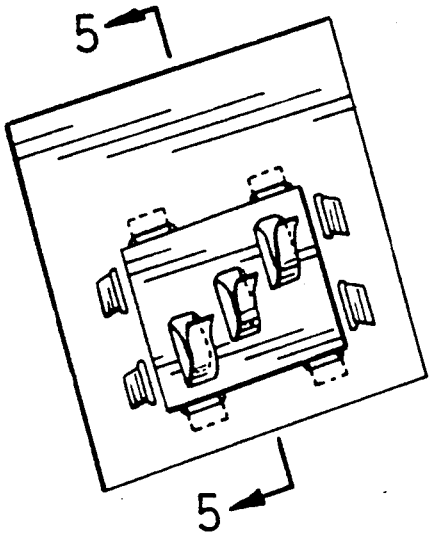
Figure 5:
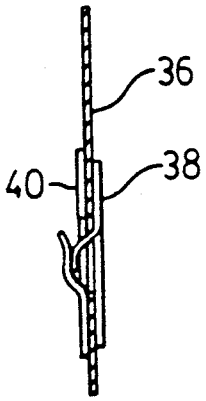
Figure 6:
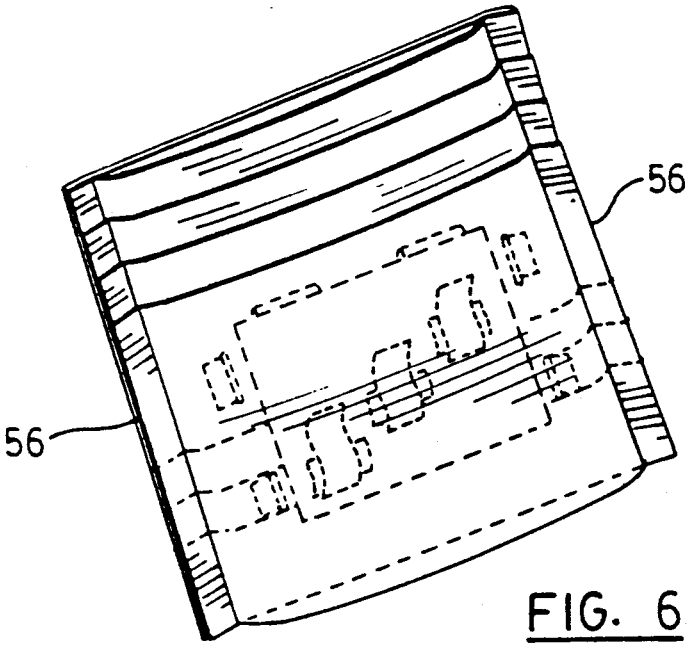
Figure 7:
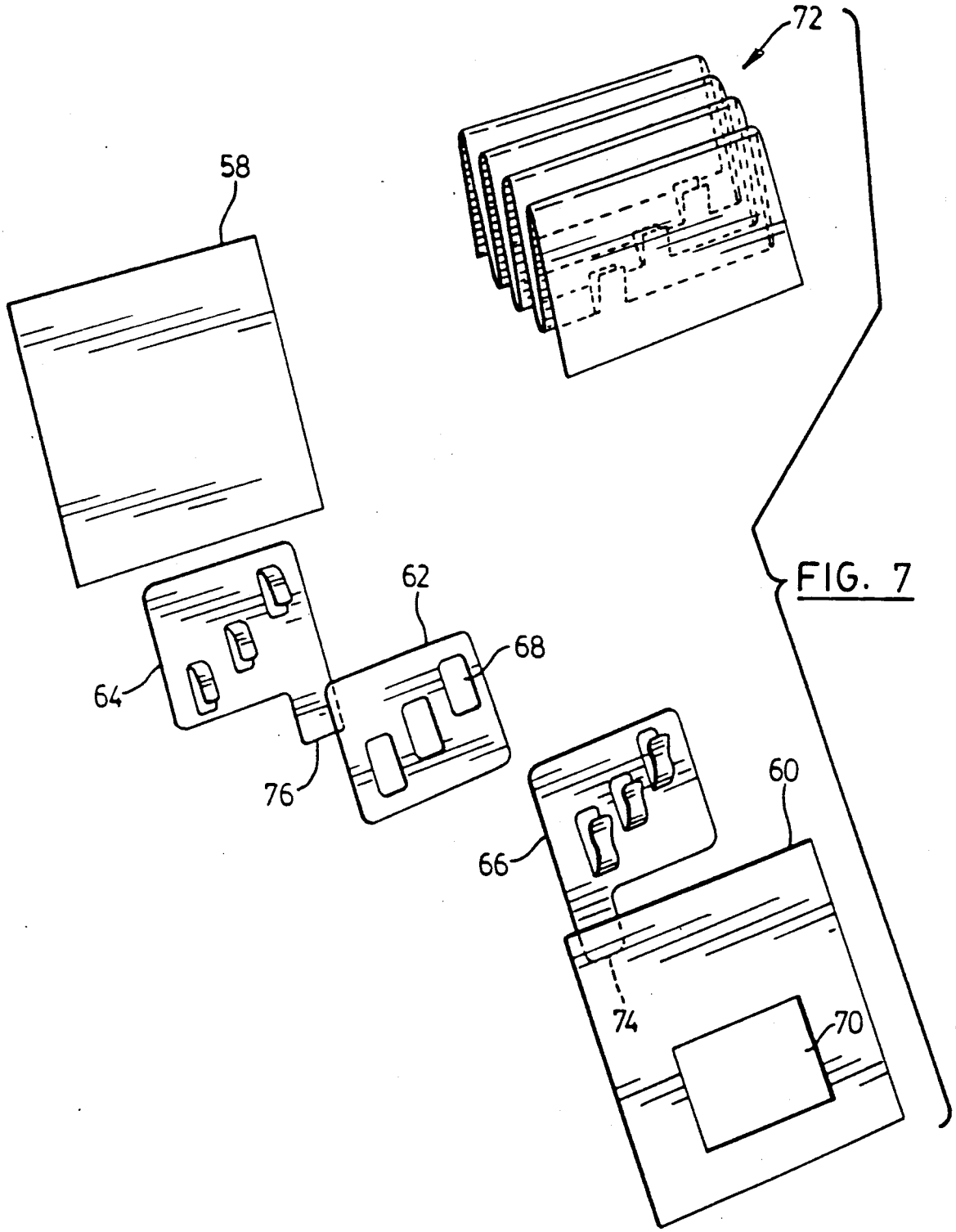
Figure 8:
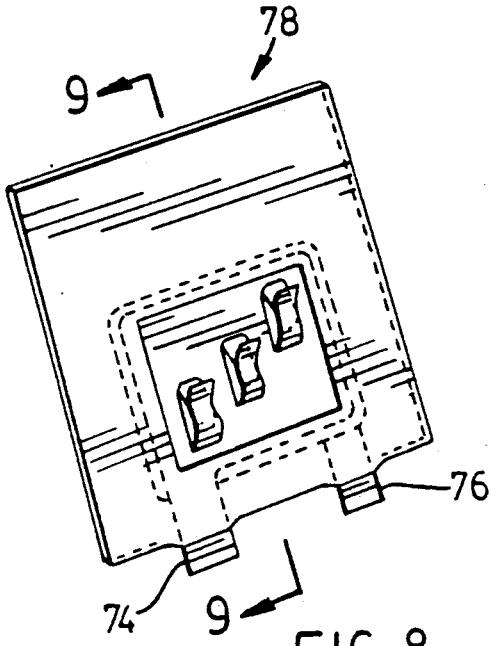
Figure 9:
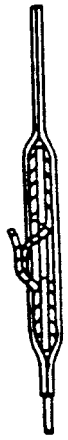
Figure 10:
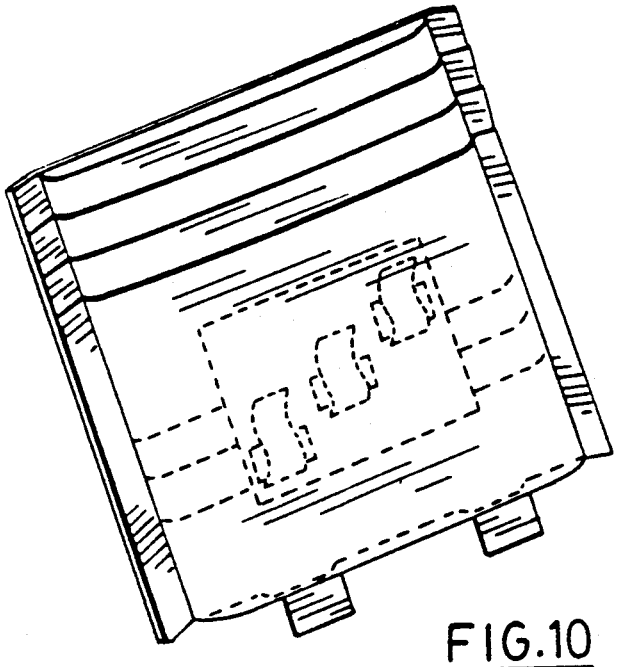
Figure 11:
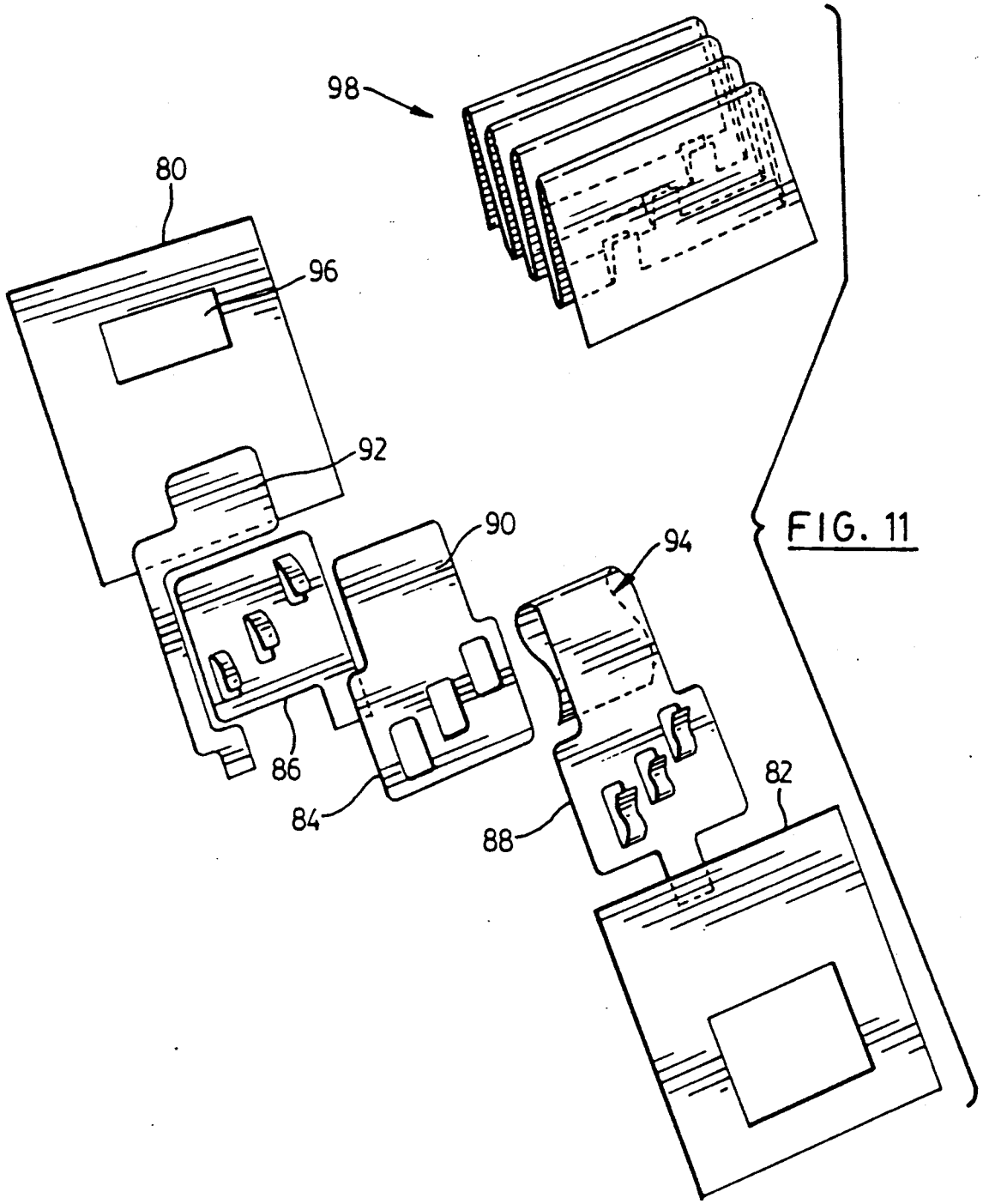
Figure 12:
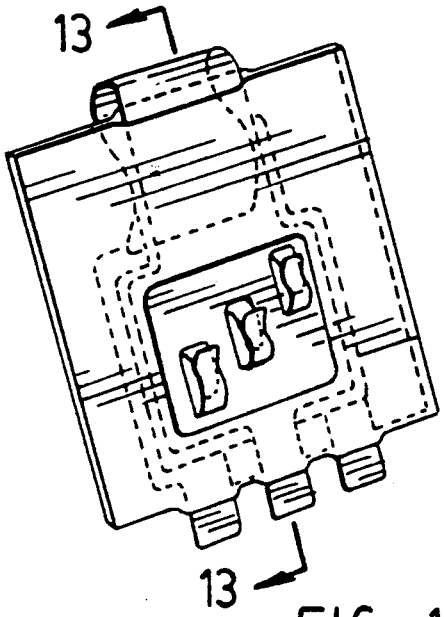
Figure 13:
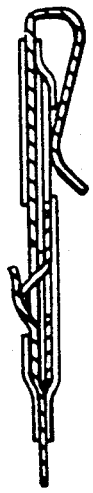
Figure 14:
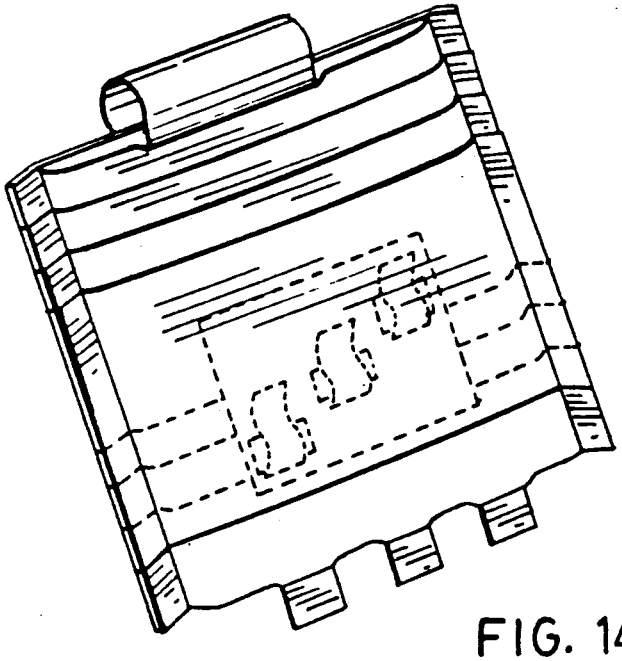
Figure 15:
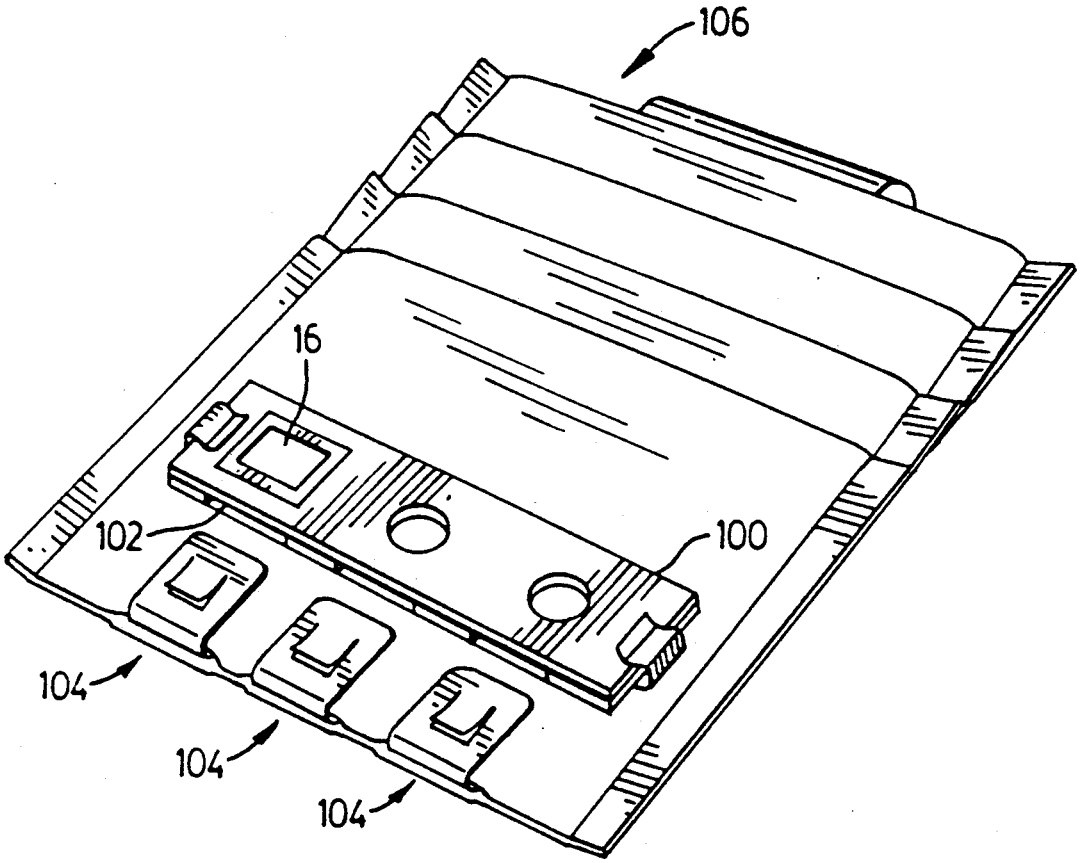
Figure 16:
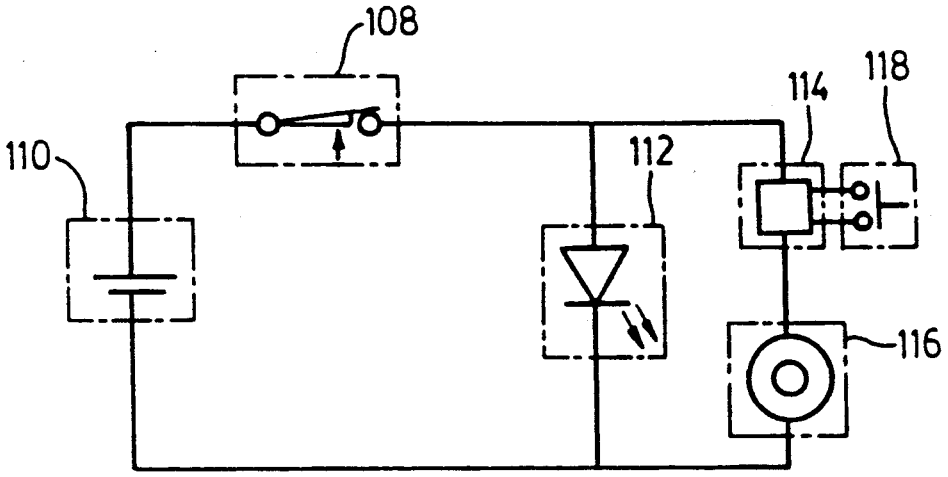
Figure 17:
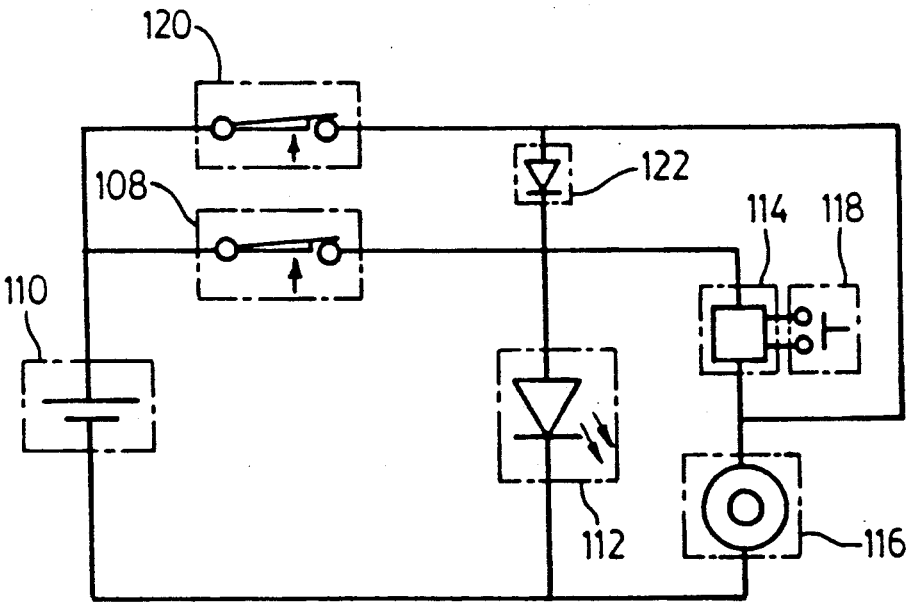
Figure 18:
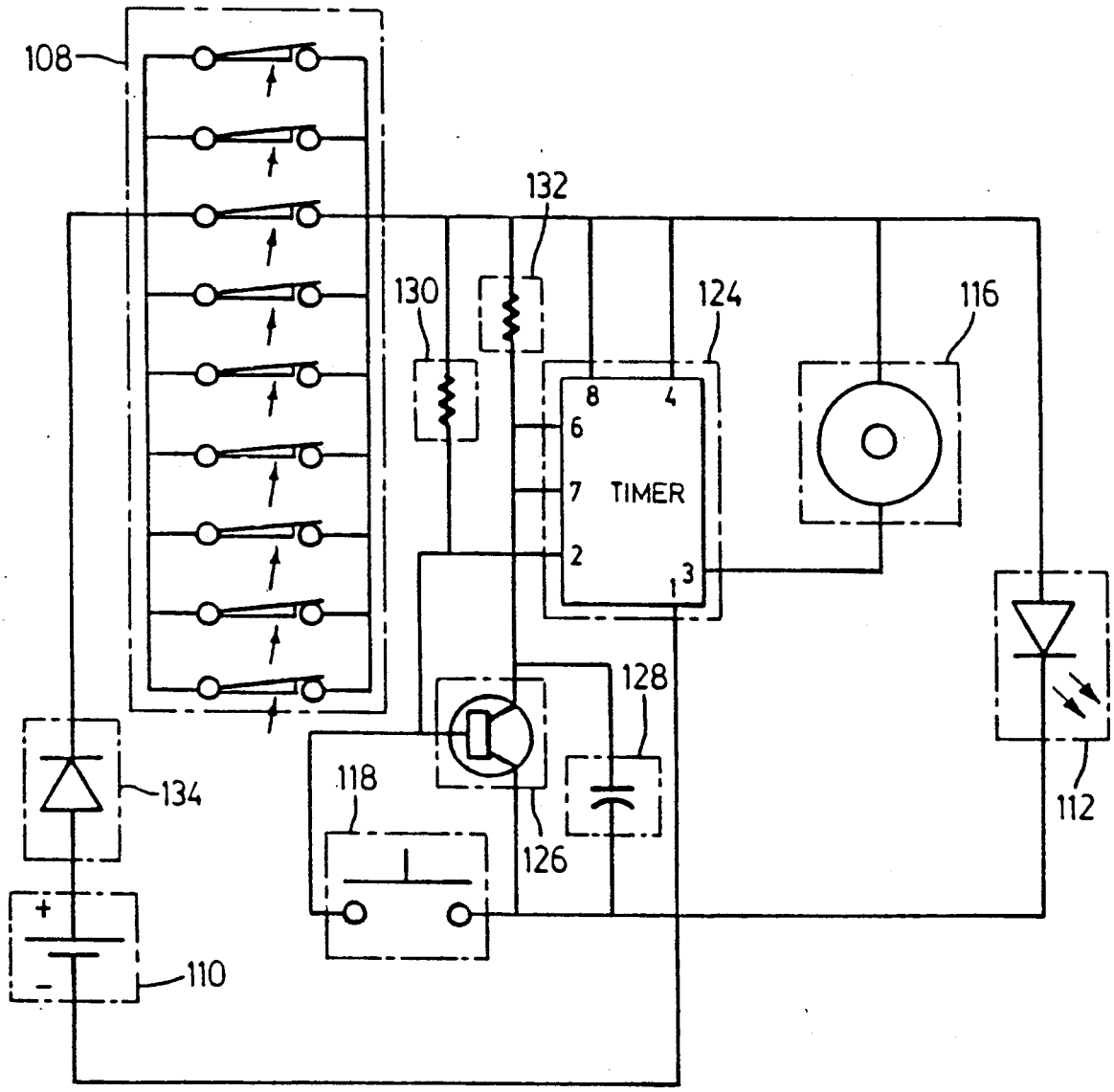

FIG. II is an exploded view of a wallet;

FIG. III is an exploded view of a document retainer-sensor sub-assembly;

FIG. IV is a perspective view of a substrate-sensor sub-assembly;

FIG. V is a cross-sectional view of FIG. IV taken along line V—V;

FIG. VI is a perspective view of a document retainer-sensor sub-assembly;

FIG. VII is an exploded view of a document retainer-sensor sub-assembly;

FIG. VIII is a perspective view of a substrate-sensor sub-assembly;

FIG. IX is a cross-sectional view of FIG. VIII taken along line IX—IX;

FIG. X is a perspective view of a document retainer-sensor sub-assembly;

FIG. XI is an exploded view of a document retainer-sensor sub-assembly;

FIG. XII is a perspective view of a substrate-sensor sub assembly;

FIG. XIII is a cross-sectional view of FIG. XII taken along line XIII—XIII;

FIG. XIV is a perspective view of a document retainer-sensor sub-assembly;

FIG. XV is an exploded view of a document retainer with alarm;

FIG. XVI is an electric circuit diagram;

FIG. XVII is an electric circuit diagram; and

FIG. XVIII is an electrical schematic diagram.

DESCRIPTION OF THE PREFERRED EMBODIMENTS

Best Modes for Carrying Out the Invention

FIG. I shows a wallet, 10 holding several credit cards, 12 with each credit card being held in a separate receptacle, 14. The wallet is purchased with blank cards which are substituted for more useful cards as required. Each receptacle is provided with a pair of contacts which close upon the withdrawal of a card to detect the absence of the card. Closing of any pair of contacts energizes an operationally connected alarm circuit which in turn immediately energizes a warning light, 20 thereby indicating that a document is missing from a receptacle and that batteries provided with the wallet are in working order.

A timing device in the form of a timer is provided in the alarm circuit and is operable as is known by those skilled in the art to commence a count to suppress the energization of an audible alarm, 18 by the batteries until the count reaches a predetermined value. The predetermined value is selected so that the alarm circuit is suppressed for a time period considered sufficient for a transaction to be completed. If it is found that the transaction is lengthy, a timer reset switch, 16 can be pressed and released to reset the timing device so that the audible alarm 18 is suppressed for another transaction time period. Resetting of the alarm timer can be repeated as many times as is necessary to complete the transaction. Reinsertion of a withdrawn document into the receptacle reopens the contacts, which in turn results in the alarm circuit being de-energized and the timer being automatically reset.

FIG. II shows a modular document retainer mechanism with an alarm, 22 prior to insertion thereof into and in an aligned position over an open receptacle, 24 provided in a wallet, 10. The wallet 10 permits the use of the document retainer while it is contained in the wallet. Apertures 26, 28, 30 and 32 are provided in the wall of the wallet receptacle to provide respective clearance for insertion and withdrawal of cards from the document retainer receptacles, 14; to permit access to the reset switch, 16; audibility of audible alarm, 18 and sight of visual indicator, 20. An alarm circuit module, 34 is shown connected operationally to a receptacle-sensor sub-assembly to form the modular document retainer mechanism with alarm, 22. Hook and loop fabric 21 is provided at the entrance of the wallet receptacle as a form of closure means to provide secure containment of the retainer in the wallet receptacle and to preserve alignment of the retainer with respect to the apertures in the wall of the wallet receptacle.

FIGS. III through VI illustrate one preferred embodiment of a receptacle-sensor sub-assembly. An exploded view is shown in FIG. III to illustrate the components thereof. A rear contact plate, 38 and front contact plate, 40, each carrying one of each pair of contacts, are attached to a substrate, 36. The substrate 36 secures the contacts (except the contact faces) in an electrically insulated manner such that the contact faces are preserved in opposed alignment and spring biased to move into engagement. Projections, 42 are provided on the periphery of the contact plates 38,40 and engage with slots, 44 formed in the substrate 36 as a means of attachment. The substrate 36 is provided with apertures, 48 to provide clearance of the rear plate contacts, 46 formed on the plate 38, thereby allowing the rear contact plates to project through the substrate 36 and engage with front plate contacts, 50 formed on the plate 40. Receptacle linings, 52 are provided and are shown as being formed from a single sheet of suitable flexible material appropriately folded to define a plurality of receptacles, each having an aperture, 54 positioned therein to allow contact faces clearance to project through and engage within the receptacle.

FIG. IV shows the contact plates sub-assembled to the substrate 36. The pre-curving of the contact plates 38,40 as illustrated in FIG. III helps the plates to fit flush to the substrate despite the reaction caused by the built in spring tension biasing the contacts formed on the plates together. FIG. V is a view along line V—V of FIG. IV, showing how the contacts 46 formed on the rear contact plate, 38 project through the aperture formed in the substrate, 36 to engage with the contacts 48 in the front contact plate, 40.

FIG. VI shows a receptacle-sensor sub-assembly which is created by fitting the receptacle linings, 52 of FIG. III, to the contact plate-substrate sub-assembly, FIG. IV. After inserting each lining 52 between and in alignment with each respective pair of contacts, the linings are attached to the substrate 36 along the marginal edges, 56. Heat-pressure fusion is shown, however, it should be realized that stitching, adhesives or staples can also be used. Electrical connections to an attached alarm circuit module can be made from the rear side of the assembly.

FIGS. VII through X illustrate a second preferred embodiment of a receptacle sensor sub-assembly. An exploded view is shown in FIG. VII to illustrate further the components. As in the first embodiment, a rear contact plate, 64 and front contact plate, 66, each carrying one of each pair of contacts are attached to a substrate. However in this embodiment, the substrate comprises a front layer, 60 and a rear layer, 58 between which the contact plates are interposed. An insulation layer, 62 is provided which, except for the contact faces, insulates the two contact plates from each other. Apertures, 68 are provided in the insulation layer 62 to provide clearance for the rear contacts, thereby allowing the rear contacts to project through the insulation layer and engage with the front contacts. The front layer of the substrate is provided with an aperture, 70 to allow exposure of the contact pairs for fitting into the receptacle linings, FIG. VIII is a view of the contact plate-substrate sub-assembly. The two substrate layers 58,60 are joined together, securely containing the contact plates and insulation layer 62 therebetween, preserving the alignment of the contacts and the spring tension urging the contact faces into engagement. Heat-pressure fusion is shown as the means for joining the front and rear substrates 58,60, however, it should be realized that staples, stitching or adhesives can also be used. Projections, 74 and 76 are provided respectively on alternate sides of the lower periphery of the front and rear contact plates. These projections extend from between the substrate layers beyond the lower marginal edge of the substrate as exposed poles for electrical connection to an alarm circuit module. The poles can be bent 180 degrees upwards and formed to slide fit and snap-lock into slots provided in the alarm circuit module as a means of simplifying electrical and structural connection. An example of this is shown in FIG. XV.

FIG. X shows the receptacle-sensor sub-assembly. Fit and attachment of the receptacle linings, 72 to the contact plate-substrate sub-assembly, 78 is similar to the first embodiment. It is conceived that a wallet can carry more than one of the previously described modular document retainers. Conductors may be built into the wallet so that several retainer-sensor sub-assemblies can be interconnected in parallel to trigger one alarm module provided in the wallet. The conductors will preferably be exposed within each wallet receptacle, to align with corresponding exposed poles on each of the retainer-sensor sub-assemblies, allowing passive electrical interconnection and simple assembly or replacement.

FIGS. XI through XV illustrate a preferred embodiment of a document retainer having an alarm provided with a releasable attachment means to attach the retainer to another object such as a conventional wallet, purse, briefcase, pocket or book. Also shown is detection means connected to the alarm circuit to trigger an alarm if the retainer becomes detached from the object to which it was attached originally.

FIG. XI is an exploded view of the components of the retainer-sensor sub-assembly. The structure is similar to the second embodiment previously described but has the following additional features. In this embodiment, the insulating layer, 84 and front contact plate, 88 each have extensions on the upper periphery, respectively 90 and 94. An extra contact plate, 92 is provided which lies in the same plane as the rear contact plate, 86 but remains in a spaced and thus electrically insulated relationship. The extension, 94 on the front contact plate projects out from between the substrate layers through the top marginal edge and is curled towards the back of the retainer to create a clip, spring biased to close upon itself. It is conceived that this curling operation can be completed after assembly of the retainer-sensor sub-assembly.

To supplement spring retention, an external assisting spring clip may be fitted over top of the detector clip. It is also conceived that a supplementary means of securing attachment to another object may be provided such as safety pins or hook and loop fabric. The extension, 90 provided on the insulating layer and the extra contact plate, 92 interpose within the clip formed by the extension of the front plate so that the back face of the extra plate engages with the inner face of the clip. To provide clearance for engagement of the inner face of the clip to the back face of the extra contact plate, an aperture, 96 is provided in the rear substrate layer, 80. The extra plate generates a unique signal to the alarm circuit when engagement of the electrical contact faces of the attachment means occurs. This unique signal circumvents any time delay means provided in association with the card sensing means so that, for instance, if the retainer becomes detached and falls to the ground, the owner does not walk too far away to hear the alarm before the alarm activates.

To facilitate connection to the alarm module the extra plate has a peripheral extension to provide a third pole that projects out of the bottom marginal edge of the substrate. It engages in a third slot provided in the alarm module.

FIG. XV shows the alarm circuit module, 100 with slots, 102 aligned with the connecting projections, 104 and in position prior to sliding the module in the direction of the arrows shown, into engagement over the projections to connect the module structurally and electrically to the retainer-sensor sub-assembly, 106. The projections are shown as being bent 180 degrees as described previously and have partly pierced and raised teeth in the center of each. The teeth are provided as a means of securely snap-locking the alarm circuit module into connection with the retainer-sensor sub-assembly. The alarm module, 100 is shown in the form of a cassette. The outer case can be formed from two injection molded halves within which all of the functional components are contained. The halves are held together with clips removable for battery replacement. The reset switch, 16 is recessed slightly in the case to help prevent false resetting of the alarm suppression timer.

FIGS. XVI and XVII illustrate embodiments of two electric circuits suitable for use in the document retainers. FIG. XVI is a circuit for the basic document retainer provided with the alarm. It shows the document sensors, 108 connected in series to a storage battery, 110. The sensors control the flow of current to two parallel circuit paths, one of which incorporates the flashing LED 112, and the other of which incorporates an audible alarm, 116 and an audible alarm suppression timer, 114. An audible alarm timer reset switch, 118 acts upon the timer, 114 alone without interfering with the rest of the circuit function.

FIG. XVII shows a circuit for the document retainer having the alarm and the releasable attachment means equipped with a detector to sense detachment of the retainer from an object to which it was originally attached. The circuit is similar to that in FIG. XVI except that there is provided a parallel control path, as an alternate means of energizing the alarms, which is gated by the detachment detector, 120. This control path bypasses the audible alarm suppression timer, connecting the audible alarm without any delay directly to the power supply. It also energizes the flashing LED 112 through a small signal diode, 122 to prevent defeating the audible alarm suppression timer in the card withdrawal situation. As described earlier, this circuit is desired due to the fact that if the retainer becomes detached and, for example, falls to the ground from the owner's pocket, delaying the warning alarms would allow the owner to walk out of range of audibility or visibility of the alarms.

A more detailed electrical schematic of the basic circuit is shown in FIG. XVIII. Reference numeral 108 shows the normally closed document retainer contact pairs which are held open by the documents held therebetween. The three retainer modules contained in the wallet shown in FIG. I are connected in parallel so that the withdrawal of any document, and resulting closing of any contact pair, allows current from the compact battery, 110 to flow into the circuit. This energizes the flashing LED 112 and starts the timing cycle, at the end of which the piezo-electric audible alarm, 116 is energized. Pressing and releasing the reset switch, 118 or replacing all of the documents and thus opening all of the contacts, resets the timer. A 555 timer integrated circuit, 124 is connected to a bipolar PNP transistor, 126 a capacitor, 128 and resistors 130 and 132 as shown. The small signal diode, 134 prevents circuit damage if a battery is inadvertently installed inverted.

It is conceived that many alternative circuit arrangements are possible, especially those using specially designed application specific integrated circuits manufactured for this particular purpose.

The present document retainer may also be used for:

1) Storage of documents in a large index file. An LED panel mounted on the front of the cabinet and/or on the dividers indicates from which cabinet and/or divider the documents were taken. Signals can be fed into a central security monitor. A connected computer can also illuminate the LEDs for quick location of retained documents.

2) The incorporation of a card retainer conveniently located and secured by key or special code in the interior of an automobile. A dashboard light or message, audible alarm and/or disabling interlock activates if the card is not replaced before attempting to start the vehicle.

3) Retainers with alarms provided in books for the purpose of retaining pertinent data storage media and/or computer software.

It should also be apparent to those of skill in the art that variations and modifications may be made to the present invention without departing from the scope thereof as defined by the appended claims.

We claim:

1. A document retainer comprising:

a plurality of receptacles, each of said receptacles for receiving and holding a document therein;

sensing means associated with each of said receptacles for detecting the presence or absence of a document in said receptacle;

an electronic circuit responsive to said sensing means and being energized by a power supply upon detection of a document absent from said receptacle by said sensing means, said electronic circuit including:

an audible alarm operable to provide an audible signal;

time delay means in communication with said audible alarm and being operable to connect said audible alarm to said power supply after a pre-determined amount of time has elapsed after energization of said electronic circuit; and switch means in communication with said time delay means, said switch means being manually actuable to reset said time delay means to inhibit said audible alarm from sounding.

2. A document retainer as defined in claim 1 wherein said time delay means includes a timer, said timer initiating a count upon energization of said circuit, said timer connecting said audible alarm to said power supply once said count reaches a pre-determined value, said switch means resetting said timer upon actuation thereof.

3. A document retainer as defined in claim 2 wherein each actuation of said switch means resets said timer, said timer resuming said count upon resetting by said switch means and the subsequent release thereof.

4. A document retainer as defined in claim 3 wherein said count reaches said predetermined value in the time taken for a typical credit card transaction to take place.

5. A document retainer as defined in claim 1 further comprising an inaudible alarm operable to provide an inaudible signal upon energization of said electronic circuit.

6. A document retainer comprising:

a receptacle having front and back walls to receive a document;

sensing means having first and second electrical contacts disposed in said receptacle, said contacts having a pair of juxtaposed faces spring biased towards one another to be engageable with one another and to establish electrical contact therebetween, said faces being maintained in a spaced relationship by insertion of a document in said receptacle, each of said contacts being secured in an electrically insulated manner at one end thereof to a substrate;

said substrate maintaining said faces in alignment and preserving said spring bias;

said receptacle front wall and back wall constituting guide means for the insertion of a document in said receptacle and between said pair of juxtaposed faces, each of said walls being provided with at least one aperture therein, each of said apertures allowing at least one of said contacts to pass therethrough so that said pair of juxtaposed faces engage and establish electrical contact therebetween in the interior of said receptacle;

said substrate extending laterally beyond said contacts to provide laterally spaced marginal edges for attachment of said substrate to one of said receptacle walls adjacent the edges thereof to maintain alignment of said substrate to said receptacle and said faces within said receptacles; and means provided to connect operatively said contacts to an alarm circuit to trigger said circuit upon the withdrawal of a document from said receptacle.

7. A document retainer as defined in claim 6 wherein attachment of said laterally spaced marginal edges of said substrate to said receptacle wall also serves to form sealed lateral marginal edges for said receptacle.

8. A document retainer as defined in claim 6 further comprising a plurality of receptacles, each of said receptacles being operable to receive and retain a document therein, each of said receptacles being provided with said sensing means.

9. A document retainer as defined in claim 8 wherein said plurality of first contacts are provided on a first electrically conductive plate and said plurality of second contacts are provided on a second electrically conductive plate, said first and second plates being attached to said substrate such that said faces are opposingly aligned, said contacts being laterally spaced on said first and second plates respectively.

10. A document retainer as defined in claim 9 wherein said plates are provided with projections on the periphery thereof and said substrate is provided with apertures to receive said projections and thereby attach said plates to said substrate.

11. A document retainer as defined in claim 10 wherein said substrate is formed from an insulating material and is interposed between said first and second plates, said substrate further including passages formed therein to permit one of the juxtaposed faces in each of said first and second contacts to pass to permit said faces to move into engagement and establish electrical contact therebetween.

12. A document retainer as defined in claim 9 wherein said substrate is formed from a pair of layers, said first and second plates being interposed between said layers, said document retainer further comprising insulation means positioned between said first and second plates, at least one of said layers having apertures provided therein to permit protrusion of said pairs of contacts therethrough; and means to join said layers and to maintain securely said plates and insulation means therebetween to inhibit lateral misalignment between said faces.

13. A document retainer as defined in claim 8 wherein said plurality of receptacles are in echelon.

14. A wallet case or cover provided with a receptacle comprising:

an opening to receive a modular document retainer and withdrawal sensor mechanism having an alarm, said receptacle being provided with a front wall and a back wall, said walls having apertures formed therein to allow the use of said mechanism while it is contained within said receptacle and permitting insertion and withdrawal of said documents from said mechanism in addition to facilitating use of manually controlled switches provided on said mechanism and functional sensing of said audible and inaudible alarms; and closure means to ensure containment of said mechanism within said receptacle and inhibiting lateral misalignment between said apertures and said mechanism.

15. A document retainer comprising:

a plurality of receptacles, each of said receptacles for receiving and maintaining a document therein;

sensing means associated with each of said receptacles for detecting the presence or absence of a document therein;

an electronic circuit responsive to said sensing means and being energized by a power supply upon detection of the withdrawal of a document from any of said receptacles; and releasable attachment means provided on said retainer to allow attachment of said retainer to another object.

16. A document retainer as defined in claim 15 wherein said attachment means is in the form of a spring clip.

17. A document retainer as defined in claim 15 wherein said attachment means is in the form of hook and loop fabric.

18. A document retainer as defined in claim 15 further comprising:

detection means associated with said attachment means and operable to sense removal of said retainer from said other object; and an alarm circuit responsive to said detection means and being energized by said power supply upon removal of said retainer from said other object.

19. A document retainer as defined in claim 18 wherein said detection means is in the form of a pair of electrical contacts.

20. A document retainer as defined in claim 15 further comprising:

an audible alarm operable to provide an audible signal;

time delay means in communication with said audible alarm and being operable to connect said audible alarm to said power supply after a predetermined amount of time has elapsed from the energization of said electronic circuit; and switch means in communication with said time delay means, said switch means being manually actuable to reset said time delay means to inhibit said audible alarm from sounding.

21. A document retainer as defined in claim 20 further comprising an inaudible alarm operable to provide an inaudible signal upon energization of said electronic circuit.

22. A document retainer as defined in claim 20 further comprising:

detection means associated with said attachment means and being operable to sense removal of said retainer from said other object;

an alarm circuit responsive to said detection means and being energized by said power supply upon removal of said retainer from said other object; and means to circumvent said time delay means and operable to energize said audible and inaudible alarms upon removal of said retainer from said other object.

23. A document retainer as defined in claim 22 wherein said attachment means is in the form of a spring clip.

* * * * *